United States Patent [19]

Russenberger

[11] 3,931,487

[45] Jan. 6, 1976

[54] ELECTRIC MOMENTARY ACTION PUSH-BUTTON SWITCH

[75] Inventor: Victor Russenberger, Nogent-sur-Marne, France

[73] Assignee: Etablissements Russenberger, Paris, France

[22] Filed: June 25, 1974

[21] Appl. No.: 482,842

[30] Foreign Application Priority Data

June 27, 1973 France ..... 73.23508

[52] U.S. Cl. ..... 200/159 R; 200/6 BA

[51] Int. Cl.[2] ..... H01H 13/52

[58] Field of Search ..... 200/6 BA, 6 B, 6 R, 159 R, 200/160, 67 DB

[56] References Cited

UNITED STATES PATENTS

| | | | |
|---|---|---|---|
| 2,599,437 | 6/1952 | Dickson | 200/67 DB |
| 3,016,439 | 1/1962 | Haberg | 200/159 R |
| 3,165,611 | 1/1965 | Haberg | 200/159 R |
| 3,331,933 | 7/1967 | Smith et al. | 200/159 R X |
| 3,378,664 | 4/1968 | Russenberger | 200/160 |
| 3,619,528 | 11/1971 | Sorenson | 200/159 R X |
| 3,731,030 | 5/1973 | Holzer | 200/159 R |

*Primary Examiner*—James R. Scott
*Assistant Examiner*—William J. Smith
*Attorney, Agent, or Firm*—Haseltine, Lake & Waters

[57] ABSTRACT

An electric switch comprising a casing having a base with a first central terminal and second and third lateral terminals mounted thereon. A pushbutton is slidably mounted in an opening of the casing opposite the base, and a metal switching member is in sliding contact with the first terminal and is able to be brought into contact either with the second or the third terminal. A spring is mounted between the switching member and the pushbutton and urges the push-button into a normally released position and pushes the switching member into contact with the first terminal and second terminals. An actuator is integral with the push-button and when the latter is depressed, it tilts the switching member around the first terminal to move the switching member away from the second terminal and into contact with the third terminal.

4 Claims, 3 Drawing Figures

ELECTRIC MOMENTARY ACTION PUSH-BUTTON SWITCH

The present invention relates to a momentary action electric push-button switch and particularly to improvements in the switch construction of my earlier U.S. Pat. No. 3,378,664.

According to the invention, the switch comprises a casing provided with a base through which pass a first terminal belonging to two electric circuits outside the casing, a second and third terminal belonging respectively to the said two circuits, said first, second and third terminals being integral with the base of the casing and arranged such that the first terminal is located between the second and the third terminals, the switch also comprising a push-button slidably mounted in an opening in the casing opposite said space, a metal switching member in sliding contact with the first terminal and able to be brought into contact either with the second terminal of with the third terminal, prestressed resilient connecting means mounted between the switching member and the push-button and which, on the one hand, urge the push-button into the normal undepressed position and on the other hand bring the switching means into contact with the first terminal and with the second terminal, thus normally closing the first electric circuit and means for rotating the switching member, integral with the push-button and able, when the latter is depressed, to pivot the switching member around the first terminal, which member separates from the second terminal and comes into contact with the third terminal, thus closing the second electric circuit.

Thus, in the inoperative position, the switching member connects the first terminal and second terminal, whereas when it is actuated by the push-button, it connects the first terminal and third terminal. In its first position, the switch may thus close a first circuit and in its second position it may supply a second circuit.

According to a particular embodiment of the invention, the resilient connecting means is constituted by a rod projecting under the push-button passing with clearance through the first terminal and through the switching means in its region of contact with the first terminal and terminating in a flared end which prevents the separation of the rod and the first terminal and thus the withdrawal of the push-button from the casing, a prestressed helical spring being wound around said rod in order to keep the switching member pressed against the first terminal and to urge the push-button into the released position.

The aforesaid drive means may be constituted by a small column projecting under the inner face of the pushbutton above the switching means, adjacent the third terminal. When the push-button is depressed, the small column pivots the switching member about the first terminal to bring it into contact with the third terminal.

Figure 1:
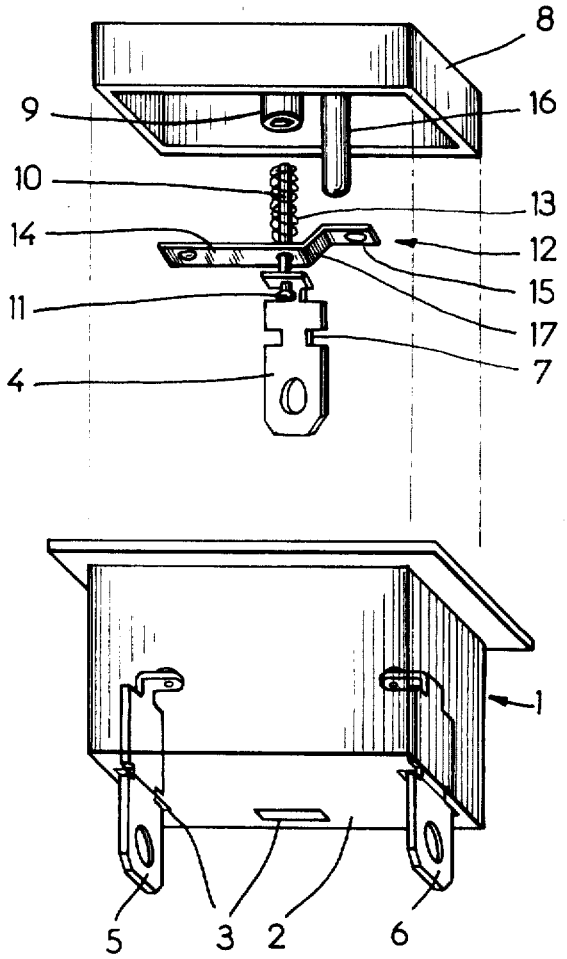
Figure 2:
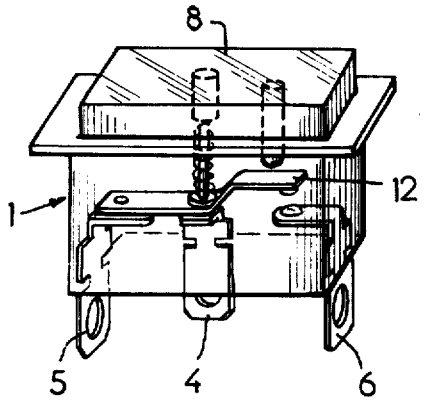
Figure 3:
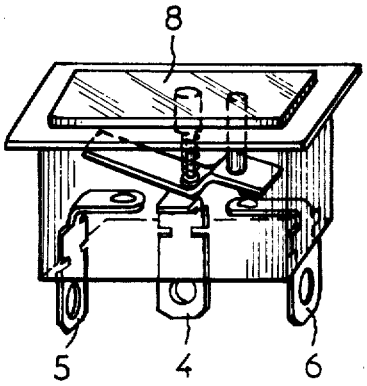

One embodiment of the invention will now be described with reference to the accompanying drawings in which:

FIG. 1 is an exploded perspective view of the switch according to the invention; and FIGS. 2 and 3 are respectively perspective views of the switch in the inoperative and active positions.

Referring to the drawings, the switch comprises a casing 1 made from moulded plastics material, which is open on its upper side and the base 2 of which comprises three slots 3 through which pass a central terminal 4 and two lateral terminals 5 and 6 penetrating the inside of the casing. Each terminal comprises a narrow section 7 in the region where it passes into the slot, which makes it possible, after the terminals have been put in position in the casing, to impart a twisting action to their portions outside the casing and thus to lock them in position. The inner ends of the terminals are folded back at right angles and support studs of metal which is a good conductor.

Slidably mounted in the opening of the casing is a push-button 8, also made from moulded plastics material. Fixed in a hollow lug 9 projecting from the inner face of the push-button is a rod 10 which terminates in a flared head 11 at its other end. The rod passes with clearance through a switching strip 12 and the stud of the central terminal 4. A prestressed helical spring 13, wound on the rod 10 and bearing against the push-button and strip 12, simultaneously urges the latter into intimate contact with the stud of the central terminal and pushes the push-button towards its upper position (FIG. 2).

The strip 12 is elongated and in its central portion comprises an angle portion 17 such that its ends are located at different levels. In the normal position, the end portion 14 at the lower level is in contact with the central terminal and with the lateral terminal 5, whereas the end portion 15 at the upper level is located above the lateral terminal 6. In this position, the switch closes a circuit connected to the terminals 4 and 5.

The push-button 8 is also provided on its inner face with a small vertical column 16 located adjacent the end portion 15 of the strip. When the push-button is depressed (FIG. 3), the small column 16 causes the strip to pivot about the stud of the central terminal 4 in order to bring the end of the portion 15 of the strip into contact with the stud of the terminal 6. Switching thus occurs towards the circuits connected to the terminals 4 and 6 of the switch.

Naturally, numerous modifications of details may be applied to the embodiment described, without diverging from the framework of the invention. For example, the switching strip 12 could be flat. The studs of the terminals 4 and 5 would thus be located at the same level and the stud of the terminal 6 at a lower level.

I claim:

1. Electric switch comprising a casing provided with a base through which pass a first terminal belonging to two electric circuits outside the casing, a second and third terminal belonging respectively to said two circuits; said first, second and third terminals being integral with the base of the casing and arranged such that the first terminal is located between the second and third terminals, the switch also comprising a push-button slidably mounted in an opening of the casing opposite said base, and a metal switching member in sliding contact with the first terminal and able to be brought into contact either with the second terminal or with the third terminal, prestressed resilient connecting means mounted between the switching member and the push-button and which, on the one hand, urges the push-button into a normally released position and, on the other hand, pushes the switching member into contact with the first terminal and with the second terminal, thus normally closing the first electric circuit and means for rotating the switching member, integral with the push-button and able, when the latter is depressed, to tilt the switching member around the first terminal such that said member separates from the second terminal and comes into contact with the third terminal, thus closing the second electric circuit, said resilient connecting means being constituted by a rod projecting under the push-button and passing with clearance through the first terminal and the switching member in its region of contact with the first terminal and terminating in a flared end which prevents the separation of the rod and the first terminal and thus the withdrawal of the push-button from the casing, and a prestressed helical spring wound around said rod in order to keep the switching member pressed against the first terminal and to urge the push-button into the released position.

2. Electric switch according to claim 1, in which said switching member is constituted by an elongated metal strip having ends located opposite the second and third terminals and its a central portion against the first terminal.

3. Electric switch according to claim 2, in which said strip comprises, in the vicinity of its central region, an angular portion sucn that one of the ends of the strip is located at a level higher than that of the other end, the three terminals being substantially at the same level.

4. Electric switch according to claim 1 in which said drive means is constituted by a small column projecting under the push-button, above the end of the strip which is opposite the third terminal.

* * * * *